United States Patent [19]

Donnelly, Jr.

[11] 4,194,499

[45] Mar. 25, 1980

[54] BED FOR STIMULATING CIRCULATION

[76] Inventor: Thomas L. Donnelly, Jr., 2304 Norwood, Independence, Mo. 64052

[21] Appl. No.: 17,125

[22] Filed: Mar. 5, 1979

[51] Int. Cl.[2] ..... A61H 1/00

[52] U.S. Cl. ..... 128/24 R; 128/33

[58] Field of Search ..... 128/24 R, 25 R, 33, 128/70, 48, 49; 5/62, 108, 109

[56] References Cited

U.S. PATENT DOCUMENTS

| | | | |
|---|---|---|---|
| 2,700,382 | 1/1955 | Brand | 128/33 |
| 2,808,828 | 10/1957 | Rubin | 128/33 |
| 2,887,691 | 5/1959 | Talarico | 5/62 |
| 3,056,144 | 10/1962 | McKinley | 5/109 |
| 3,247,528 | 4/1966 | Swenson | 5/62 |
| 3,259,921 | 7/1966 | Alsobrook | 5/62 |
| 3,392,723 | 7/1968 | Calvin | 128/24 R |
| 3,441,014 | 4/1969 | Ramsey | 128/33 |
| 3,506,525 | 4/1970 | Freemantle | 156/561 |
| 3,653,080 | 4/1972 | Hafele | 5/108 |
| 3,711,876 | 1/1973 | Kirkland et al. | 5/62 |
| 3,806,966 | 4/1974 | Thompson | 5/109 |

*Primary Examiner*—Lawrence W. Trapp

*Attorney, Agent, or Firm*—Schmidt, Johnson, Hovey & Williams

[57] ABSTRACT

Therapeutic apparatus for treatment of patients requiring stimulation of blood circulation has a main, castered, L-shaped frame beneath a secondary, L-shaped, mattress-supporting frame, presenting uprights that are pivotally interconnected at their upper ends for continuous swinging movement of the secondary frame alternately to upper and lower inclined, dwell positions about a transverse, horizontal axis disposed at a height essentially the same as that of the head of the patient lying on the mattress. A cam and timer-controlled motor on the main frame, remote from the uprights, has cranks on its outer shaft that are pivotally connected at preselected positions on links, in turn swingable on the secondary frame, for varying the extent of swinging of the secondary frame in both directions.

12 Claims, 6 Drawing Figures

20
24
32
12
34
38
16
26
28
10
36
14
40
22
30
42
18
52
54
46
64
60
62
58
44
100
4
3

BED FOR STIMULATING CIRCULATION

An example of one type of bed for stimulating circulation generally relevant to my present invention is that disclosed by U.S. Pat. No. 2,700,382 of Jan. 25, 1955. It is, however, therein contended that one end of the bed should rise and fall by virtue of vertical, rectilinear reciprocation of the actuating mechanism and that the opposite, castered end of the bed should tilt fore and aft on the floor during actuation. The entire actuating assembly is self-contained and carried the proximal end of the bed through use of links on the bed hooked over a vertically shiftable pin rather than be designed as components of the bed itself, resulting in substantial movement of the patient's head regardless of where on the bed his head is positioned. Moreover, but one rest period, intermediate the ends of the stroke, is provided by this patentee.

In accordance with the appreciably simpler arrangement of my present invention, on the other hand, the mattress, or other patient-supporting surface of the bedstead, swings relative to the stationary main frame of the bedstead about a fixed horizontal axis disposed transversely of the headboard of the bedstead at an elevation coincident with the height of the head of the patient.

The power means for swinging the mattress to its upper and lower positions, both inclined to the horizontal fore and aft of the mattress, interconnects the main frame of the bedstead and its mattress-supporting, secondary frame remote from the headboard such as to preclude movement of the main frame relative to the floor or other supporting surface for the main frame, and precludes all lateral tilting of the mattress.

By virtue of the fact that the patient's head is closely adjacent the axis of swinging movement of the secondary frame, his head movement is limited essentially to a very slight rotation with both horizontal and vertical movement of the patient's head virtually eliminated.

The position of the patient on the mattress remains unchanged because the movement is extremely smooth, quiet, vibrationless and steady such that he remains undisturbed with essentially no sensitivity to the swinging action and no feeling of rising or falling.

The arrangement permits, therefore, the mattress-supporting frame to be swingably mounted on any stationary support, not limited to a moveable bedstead, wheeled or otherwise, and in such manner that neither the head nor the foot of the mattress reciprocates either vertically or horizontally along rectilinear paths of travel, all because of the fact that the axis of swinging movement cannot rise, fall or shift in any other direction.

It is contemplated by the instant invention further that the extent of movement of the secondary frame to its upper and lower limits and, therefore, the degree of inclination above and below horizontal, be variable in accordance with the requirements of the patient's physical condition and the desires of his doctor; that the period of time for movement between the two extremes be constant in both directions regardless of the chosen variances in the extent of travel; that the speed of movement be relatively slow and not vary appreciably, regardless of the pre-selected extent of movement; and that preselected periods of rest be provided both at the upper and lower ends of the stroke.

Other types of oscillatory beds with which I am familiar are those disclosed in the following U.S. Pat Nos.:

2,808,828
3,056,144
3,247,528
3,392,723
3,653,080
3,806,966

Among the most relevant, in No. 3,247,528, the bed is raised and lowered along its legs at either or both of its ends. In No. 3,392,723, the tiltable portion of the device is capable only of rising and falling above horizontal. The movement in No. 3,653,080 is limited to a rocking chair effect, and in No. 3,806,966, the action is only comparable to a simple rocker.

To be sure, many suggestions have been made relative to adjustable hospital beds, but not of direct relevance to the instant invention because of inability to constantly oscillate. I am aware of the following U.S. Pat. Nos. of that nature:

5,506,525
2,887,691
3,259,921
3,441,014
3,711,876

Figures 1, 3:
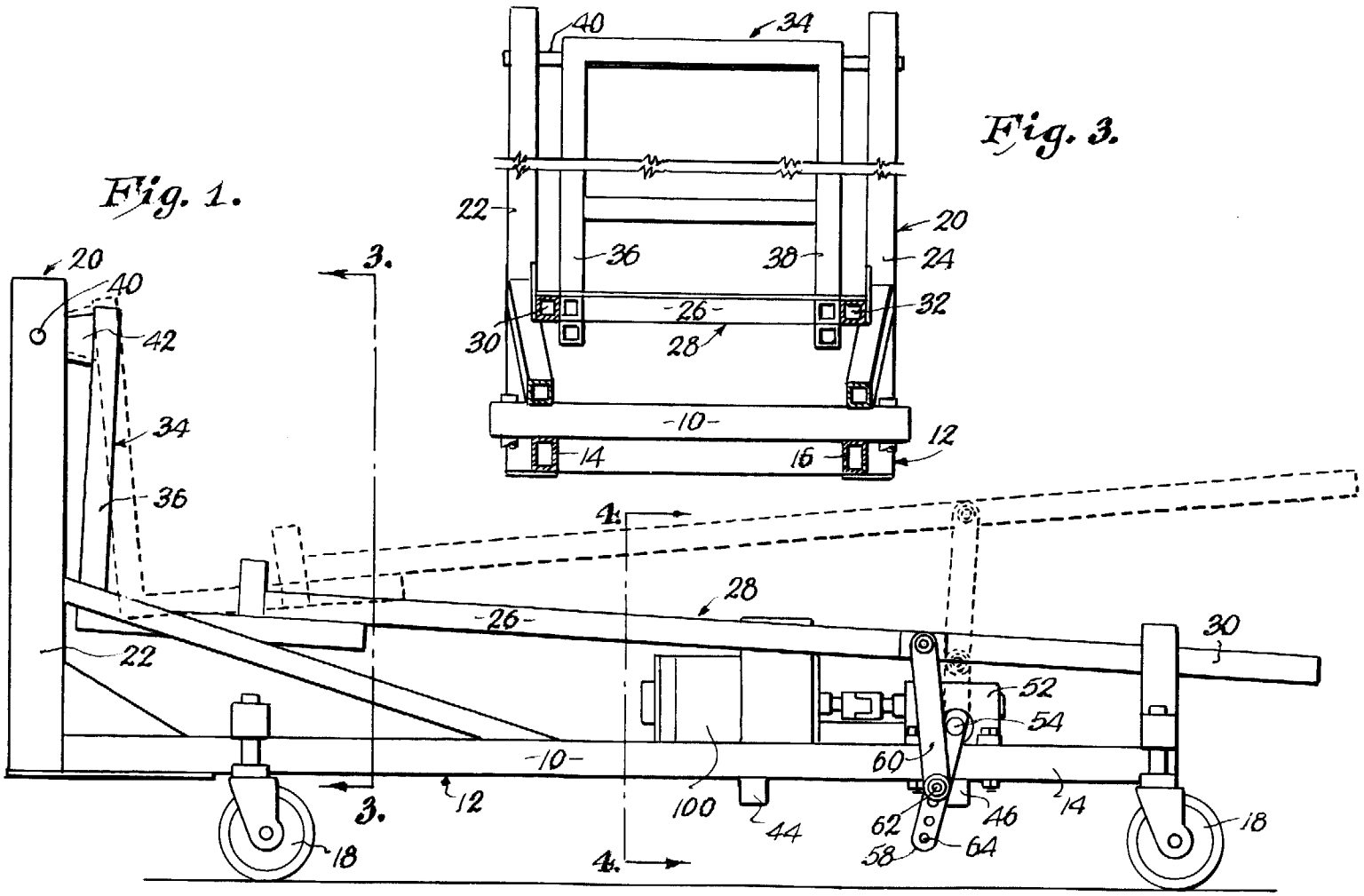
FIG. 1 is a side-elevational view of a bed for stimulating circulation made in accordance with my present invention.
FIG. 3 is a cross-sectional view taken on Line 3—3 of FIG. 1.
Figure 2:
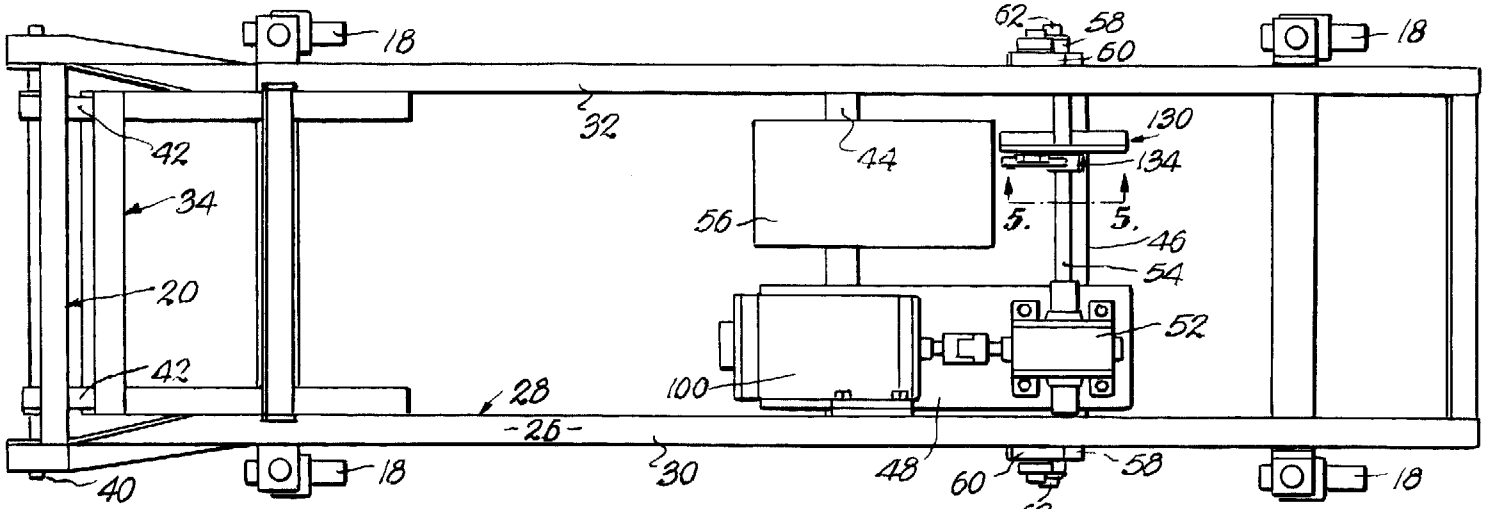
FIG. 2 is a top-plan view thereof.

An L-shaped main frame 10 has a horizontal section 12 which includes a pair of horizontally spaced, elongated, interconnected, longitudinal beams 14 and 16 supported by castered wheels 18. An upright 20 integral with one end of the frame 10 has a pair of horizontally spaced, elongated, interconnected, vertical studs 22 and 24.

An L-shaped secondary frame 26 has a normally horizontal portion 28 above the section 12, adapted to support a mattress (not shown), and which includes a pair of horizontally spaced, elongated, interconnected, longitudinal pieces 30 and 32. An upright 34 integral with one end of frame 26 has a pair of horizontally spaced, elongated, interconnected, normally vertical parts 36 and 38.

A horizontal rod 40 interconnecting the studs 22 and 24 adjacent their upper ends pivotally supports the frame 26 through brackets 42 integral with parts 36 and 38 and extending rearwardly therefrom at their upper ends. When the patient is lying on the mattress, his head is adjacent the upright 34 at a height substantially the same as the height of the rod 40.

Figure 5:
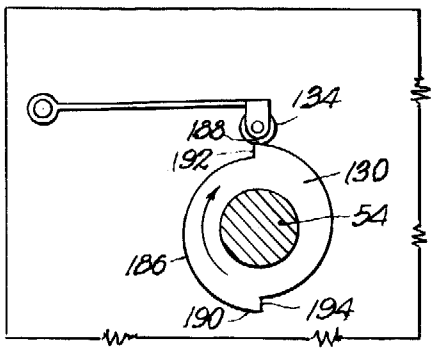
FIG. 5 is an enlarged fragmentary cross-sectional view taken on Line 5—5 of FIG. 2.
Figure 4:
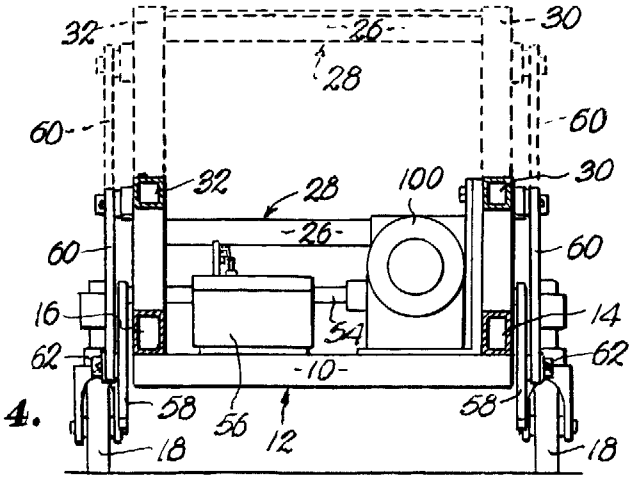
FIG. 4 is a cross-sectional view taken on Line 4—4 of FIG. 1.

Cross elements 44 and 46 between beams 14 and 16 support a base plate 48 which, in turn, carries an electrical motor 100 and a gear reducer 52 connected with the output shaft of motor 100. Output shaft 54 of gear reducer 52 has a cam 130 connected thereto for actuating a cam follower 135 (FIG. 5) as hereinafter more particulary described in connection with FIG. 6. Electrical control means (also hereinafter described) is contained in a housing 56 which may be mounted on one of the elements 44, 46.

Two lift cranks 58, rigid to the shaft 54 at its ends, are pivotally connected to corresponding links 60, in turn pivotally connected to proximal pieces 30 and 32 remote from upright 34, by removeable pins 62 selectively received in one of a number of holes 64 in the cranks 58, such that the extent of upward and downward movement of the frame 26 may be varied.

Figure 6:
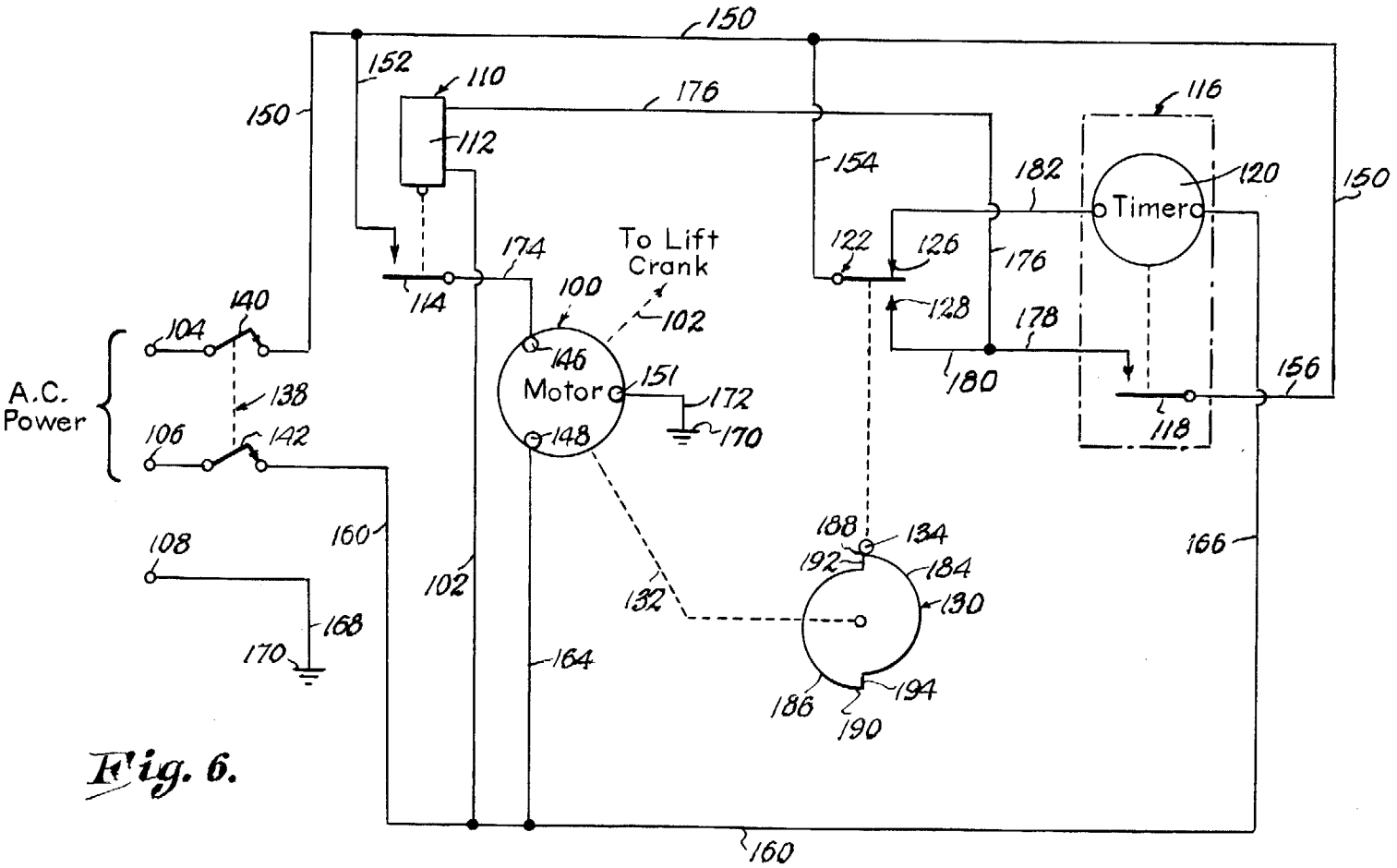
FIG. 6 is a schematic circuit diagram of the electrical control means for intermittently operating the actuating motor to provide pauses at the fully raised and fully lowered positions of the mattress-supporting frame between intervals of raising or lowering.

The electrical control means for operating the frame 26 to alternately raise and lower the frame 26 with interspersed periods of pause when the frame 26 is in its fully raised and fully lowered conditions, is shown in FIG. 6. In addition to the motor 100, which is drivingly connected to the lift cranks 58 as indicated by the arrow 102, the electrical control means of my preferred embodiment broadly includes power terminals 104 and 106 adapted for coupling to a source of single phase, alternating current, electrical power; an electrical relay 110 having an actuating coil 112 and a normally open, single pole, single throw relay switch 114 adapted to close when the coil 112 is energized; a delayed close, electrical switch timer unit 116 having a normally open single pole, single throw timer switch 118 and an electrical actuating device 120 operably coupled with the switch 118 and adapted to close the latter following a predetermined delay after the device 120 has been energized; a single pole, double throw electrical switch 122 having a pole piece 124 and a pair of alternately contacted contacts 126 and 128; the cam 130 mechanically coupled with the motor 110 for rotation by the latter as indicated by the dotted line 132; the cam follower 134 associated with the cam 130 and mechanically coupled with the pole piece 124 of the switch 122 for actuating the latter as indicated by the dotted line 136; a ganged power switch 138 having circuit breakers 140 and 142 preferably provided in the leads for the electrical power being employed; and electrical connections between the above mentioned electrical components as hereinafter more fully described.

Although I prefer to utilize a single phase alternating current type motor 100 having terminals 146 and 148 and desirably a case grounding connection 151, it will be apparent to those skilled in the art that a direct current motor or, with a conventional third power lead, even a three-phase alternating current motor could be utilized. The power terminal 104 is coupled through circuit breaker 140 with a line 150, which is in turn coupled through lead 152 with one of the contacts of the relay switch 114, through lead 154 with the pole piece 124 of the cam switch 122, and through lead 156 with one of the contacts of the timer switch 118. The power terminal 106 is coupled through the circuit breaker 142 with a line 160 and in turn through a lead 162 with one end of the relay coil 112, through a lead 164 with the terminal 148 of the motor 100, and through a lead 166 with one terminal of the actuating device 120 of the timer unit 116. A ground terminal 108 associated with the power source in the preferred embodiment is coupled with the case grounding connections 151 of the motor 100 via lead 168, ground 170 and a lead 172.

The terminal 146 of the motor 100 is coupled through a lead 174 with the other contact of the relay switch 114. The other end of the relay coil 112 is coupled through leads 176 and 178 with the other contact of the timer switch 118, and through leads 176 and 180 with the contact 128 of the relay switch 122. The contact 126 of the cam switch 122 is coupled through lead 182 with the other terminal of the actuating device 120 of the timer unit 116.

The cam 130 of my preferred embodiment is provided with a pair of radially rising cam surfaces 184 and 186 respectively terminating at high points 188 and 190 adjacent radially inwardly extending drop off shoulders 192 and 194 respectively. The cam switch 122 is preferably of the snap action type, and the follower 134 coupled with the pole piece 124 of the switch 122 is so associated with the cam 130 that the pole piece 124 of the switch 122 will snap positively into contact with the contact 126 when the follower 134 arrives at a location adjacent either of the high points 188 or 190 of the cam 130, which is the condition of the switch 122 illustrated in FIG. 6, so that the pole piece 124 of the switch 122 will snap into positive contact with the contact 128 as soon as the cam 130 rotates to permit the follower 134 to drop over either of the shoulders 192 or 194, and so that the pole piece 124 will not again shift into engagement with the contact 126 until the cam 130 has rotated sufficiently (in a clockwise direction as illustrated in FIG. 6) for the follower 134 to again arrive at one of the high points 188 or 190. The mechanical coupling 132 between the motor 100 and the cam 130 is so arranged that the follower 134 will arrive at the high point 188 when the frame 26 is in its fully lowered condition and will then subsequently arrive at the high point 190 when the frame 26 has been moved to its fully elevated position.

The timer 116 may be of any of the commonly available types in which a timer switch 118, which is normally open, is adapted to be closed by an actuating device 120 only after an appropriate period of time delay following energization of the electrically responsive actuating device 120 forming a part of the timer unit 116. In the preferred embodiment, I employ with good results a type 500 "on-delay" timer (commercially available from Paragon Electric Company, 606 Parkway Blvd., Two Rivers, Wis. 54241) for the timer unit 116, and, in that particular commercial unit, the actuating device 120 involves a solenoid and other appropriate mechanism (not shown), as well as a delay adjustment setting knob, which I find desirable in permitting selection of the periods during which the frame 26 will pause in its fully lowered and fully elevated positions, which is selectible by controlling the amount of time delay between energization of the actuating device 120 and its delayed closing of the timer switch 118, as will become apparent from consideration of the operation of the control means as hereinafter explained.

In FIG. 6, the control means are illustrated in the condition which would prevail following arrival of the frame 26 at its fully lowered position, which has caused the follower 134, upon arriving at the high point 188 of the cam 130, to shift the pole piece 124 of the cam switch 122 into positive engagement with the contact 126. This completes an energizing circuit for the actuating device 120 of the timer unit 116 traceable from the power terminal 104 through circuit breaker 140, line 150, lead 154, pole piece 124 and contact 126 of cam switch 122, and lead 182 to one terminal of the device 120, and thence from the opposite terminal of the device 120 through lead 166, line 160 and cicuit breaker 142 to the power lead 106. As illustrated in FIG. 6, therefore, it will be understood that the actuating device 120 of the timer unit 116 has been energized and is operating to measure the delay interval before it will close the timer switch 118, but, assuming that interval has not yet expired, then timer switch 118 remains open and the frame 26 will continue to pause in stationary condition at its fully lowered position. It will also be observed that, in this condition of the control means, with the timer switch 118 still open and the pole piece 124 of the cam switch 122 moved out of engagement with the contact 128, no energizing path for the relay coil 112 is completed, so that the relay switch 114 remains open, and the motor 100 remains de-energized and stopped.

When the predetermined period of time delay selected for operation of the timer unit 116 has expired, the actuating device 120 thereof will close the timer switch 118. This completes an energizing circuit for the coil 112 of the relay 110 traceable from power terminal 104 through circuit breaker 140, line 150, lead 156, then closed timer switch 118, and leads 178 and 176 to one end of the coil 112, and thence from the other end of the coil 112 through lead 162, line 160 and circuit breaker 142 to the power terminal 106. Upon such energization of the coil 112 of the relay 110, the relay switch 114 is closed to complete an energizing circuit for the motor 100 from the power terminal 104 through the circuit breaker 140, line 150, lead 152, then closed relay switch 114 and lead 174 to the motor terminal 146, it being noted that the other terminal 148 of the motor 100 is continuously coupled with the other power terminal 106 as previously noted.

Upon such energization of the motor 100, it commences to raise the frame 26 from its fully lowered position towards its fully raised position through the mechanical couplings previously described. At the same time, energization of the motor 100 commences to rotate the cam 130, and the follower 134 then rides over the shoulder 192 onto the lowermost portion of the cam face 186. Such movement of the follower 134 causes the pole piece 124 of the snap action switch 122 to shift out of engagement with the contact 126 and into positive contact with the contact 128. That actuation of the switch 122 has two effects. First, it interrupts the previously traced energization circuit for the actuating device 120 of the timer unit 116, which opens the timer switch 118, resets the actuating device 120 and places the timer unit 116 in condition for carrying out another cycle of time delayed closing of the switch 118 after an appropriate interval following the next energization of the actuating device 120. Secondly, the last-mentioned actuation of the switch 122 completes a new circuit for continuing energization of the coil 112 of the relay 110, which may be traced from the power terminal 104 through the circuit breaker 140, line 150, lead 154, pole piece 124 and contact 128 of cam switch 122, and leads 180 and 176 to one end of the coil 112, which is oppositely coupled with the power lead 106 as previously described. With the coil 112 of the relay 110 thus being maintained in energized condition, the relay switch 114 is maintained in its closed condition to continue the previously traced energizing circuit to the terminal 146 of the motor 100. Accordingly, the motor 100 continues to operate to raise the frame 26 toward its fully elevated position until that position is reached, at which moment the cam 130 whose rotation is coordinated with the positioning of the frame 26 arrives at a rotated condition thereof in which the high point 190 of the cam 130 moves into that juxtaposition with the follower 134 necessary for the latter to actuate the snap action switch 122 back into a condition in which the pole piece 124 thereof is moved out of engagement with the contact 128 and into positive contact with the contact 126. This, of course, commences a new cycle of the timer unit 116 during which the actuating device 120 thereof is immediately energized and commences to measure the predetermined delay interval, at the end of which interval the device 120 will again close the timer switch 118 in exactly the manner previously described for the condition of the apparatus in which the frame 26 is pausing at the fully lowered position thereof. During the cycle of the timer unit 116 last referred to, the frame 26 similarly pauses for a predetermined interval of delay while in its fully raised position, until the timer switch 118 is closed by the actuating device 120, whereupon the energizing circuit to the terminal 146 of the motor 100 is again restored, the motor 100 commences to run to lower the frame 26, and the cam 130 rotates sufficiently for the follower 134 to drop off of the shoulder 194 onto the cam surface 184. Again, the motor 100 continues to run to complete the lowering of the frame 26 to its fully lowered position, whereupon the high point 188 forces the follower 134 to again actuate the snap action switch 122 to move the pole piece 124 into positive contact with the contact 126, whereupon such cycling of the control means will continue indefinitely as long as the power switch 138 remains in its closed condition.

I claim:

1. Therapeutic apparatus for treatment of patients requiring stimulation of blood circulation, said apparatus including:

an elongated, normally horizontal frame adapted to support bedding upon which the patient lies during treatment, with the patient's head at one end of the frame;

means at said end pivotally supporting the frame for swinging movement about a horizontal axis disposed transversely of the frame at an elevation substantially the same as that of said head of the patient on the bedding; and power means coupled with the frame remote from said end for swinging the frame about said axis to a first, longitudinally inclined position sloping upwardly toward the opposite end of the frame or to a second, longitudinally inclined position sloping downwardly toward said opposite end.

2. The invention of claim 1; and means controlling said power means for continuously swinging the frame to and from said inclined positions alternately.

3. The invention of claim 2, said controlling means having means for holding the frame at each of said inclined positions for a preselected period of time.

4. The invention of claim 1; and means for varying the extent of movement of the frame to each of said inclined positions.

5. The invention of claim 1, said frame having an upright at said one end receiving said pivotal means at the upper end of the upright.

6. The invention of claim 1; and structure supporting and common to said pivotal means and said power means.

7. The invention of claim 6, said frame and said structure each having an upright at said one end, said pivotal means interconnecting the uprights at their upper ends.

8. The invention of claim 6, said power means including an electric motor carried by said structure, there being an output shaft operably coupled with the motor and provided with crank means; link means swingably connected with the frame; and means pivotally interconnecting the crank means and the link means at any one of a number of preselected locations for varying the extent of movement of the frame to each of said inclined positions.

9. The invention of claim 8; and means including a cam on the shaft controlling the motor for continuous swinging movement of the frame to and from said inclined positions alternately.

10. The invention of claim 9; and timer means operably coupled with the motor for deenergizing the latter for a predetermined period of time as the frame reaches each of its inclined positions.

11. The invention of claim 1, said power means including an electrical motor, and an energizing circuit for said motor coupled with the latter and adapted for coupling with a source of electrical power; and controlling means for causing said power means to continuously swing the frame between said inclined positions thereof with pauses of predetermined interval at each of said inclined positions, said controlling means including relay means having an electrically responsive actuating coil operably coupled with a relay switch electrically coupled with said energizing circuit for selectively completing and interrupting said energizing circuit responsive to changes in the state of energization of said actuating coil, timer means having an electrically responsive actuating device operably coupled with a timer switch for selectively actuating said timer switch after a predetermined interval of delay following energization of said actuating device and for restoring said timer switch to unactuated condition upon deenergization of said actuating device, cam switch means having a cam operably coupled with said motor for rotation by the latter and a cam switch operably coupled with said cam for selective actuation of said cam switch from a standby condition thereof prevailing during swinging of the frame between said inclined positions to an operated condition thereof whenever said motor has swung the frame to either of said inclined positions of the latter, means presenting a primary control circuit path through said cam switch and said actuating coil for controlling the state of energization of the latter to cause said relay switch to complete said energizing circuit for said motor whenever said cam switch is in said standby condition thereof, means presenting a secondary control circuit path through said timer switch and said actuating coil for controlling the state of energization of the latter to cause said relay switch to complete said energizing circuit for said motor whenever said timer switch is in its actuated condition, and means presenting a timer control circuit path through said cam switch and said actuating device for energizing the latter whenever said cam switch is actuated into said operated condition thereof.

12. The invention of claim 11, said relay switch being normally open and being closed upon energization of said actuating coil, said timer switch being normally open and being closed said predetermined interval after energization of said actuating device and until the latter is deenergized, said cam switch having pole means shiftable by said cam from engagement with a contact connected with said timer switch into engagement with a contact connected with said actuating device as said cam switch is actuated from its standby condition into its operated condition.

* * * * *